United States Patent [19]

Bies

[11] 4,233,734

[45] Nov. 18, 1980

[54] RETRACTABLE BLADE KNIFE

[75] Inventor: Sylvester W. Bies, Bloomfield, Conn.

[73] Assignee: The Stanley Works, New Britain, Conn.

[21] Appl. No.: 5,022

[22] Filed: Jan. 22, 1979

[51] Int. Cl.[3] ..... B26B 1/08
[52] U.S. Cl. ..... 30/162
[58] Field of Search ..... 30/162, 293, 2

[56] References Cited

U.S. PATENT DOCUMENTS

| | | | |
|---|---|---|---|
| 3,079,686 | 3/1963 | Christy | 30/162 |
| 4,028,758 | 6/1977 | O'Conner | 30/162 |
| 4,063,356 | 12/1977 | Hepworth | 30/162 |
| 4,089,112 | 5/1978 | Richards | 30/162 |

FOREIGN PATENT DOCUMENTS

| | | | |
|---|---|---|---|
| 2648423 | 4/1978 | Fed. Rep. of Germany | 30/162 |

*Primary Examiner*—Jimmy C. Peters
*Attorney, Agent, or Firm*—Prutzman, Kalb, Chilton & Alix

[57] ABSTRACT

A retractable blade knife of the type having an elongate tubular handle and an elongate flat thin blade mounted for longitudinal sliding movement in the handle, is provided with a combination slide and latching member for positioning the blade which includes a slide mounted for sliding movement on the edges of a longitudinal slot in the handle and a flexible thumbpiece extending rearwardly from the slide having a tooth normally engageable with a row of teeth along one edge of the longitudinal slot and being disengageable therefrom when the thumbpiece is flexed inwardly of the handle.

3 Claims, 6 Drawing Figures

RETRACTABLE BLADE KNIFE

The present invention relates to retractable blade knives and is concerned with an improvement in such knives pertaining particularly to the means employed for extending and retracting the blade and latching it in selected extended or retracted position.

A well-known type of retractable blade knife is one having an elongate tubular handle and a thin narrow flat blade slidably mounted therein which is extensible from one end of the handle when the knife is to be used and which can be entirely retracted within the handle when the knife is being stored or carried. Such a knife is shown, by way of example, in prior U.S. Pat. No. 4,103,421.

In the knife disclosed in U.S. Pat. No. 4,103,421, the blade is extended and retracted by means of a finger- or thumb-actuated slide having a locating detent cooperating with the handle which is released when sufficient pressure is applied to the slide in a direction to extend or retract the blade. The knife handle has a blade wedging mechanism at the side of the blade opposite from the slide which can be manually operated to retain the blade in selected extended or retracted position. Accordingly, locating the blade in selected extended or retracted position and retaining it there requires coordinated manipulation of two separate mechanisms and retention of the blade is not positive because of its dependency upon frictional engagement with the blade.

Accordingly, it is an aim of the invention to provide an improved retractable blade knife of the type referred to which overcomes the disadvantages of the prior art particularly with respect to simplicity and ease of operation and with respect to security and reliability of the blade holding or latching operation. Included in this aim is the provision of such a knife which is simple and economical to fabricate and assemble and which is compact in design.

Another aim of the invention is to provide these improvements in a retractable blade knife of a type which is easily assembled and disassembled for replacement of the blade and which is of rugged construction providing a long service life.

Other aims will be in part obvious and in part pointed out in more detail hereinafter.

A better understanding of the invention will be obtained from the following description and the accompanying drawing of an illustrative application of the invention.

DESCRIPTION OF THE PREFERRED EMBODIMENT

Figures 1, 2, 3, 4, 5, 6:
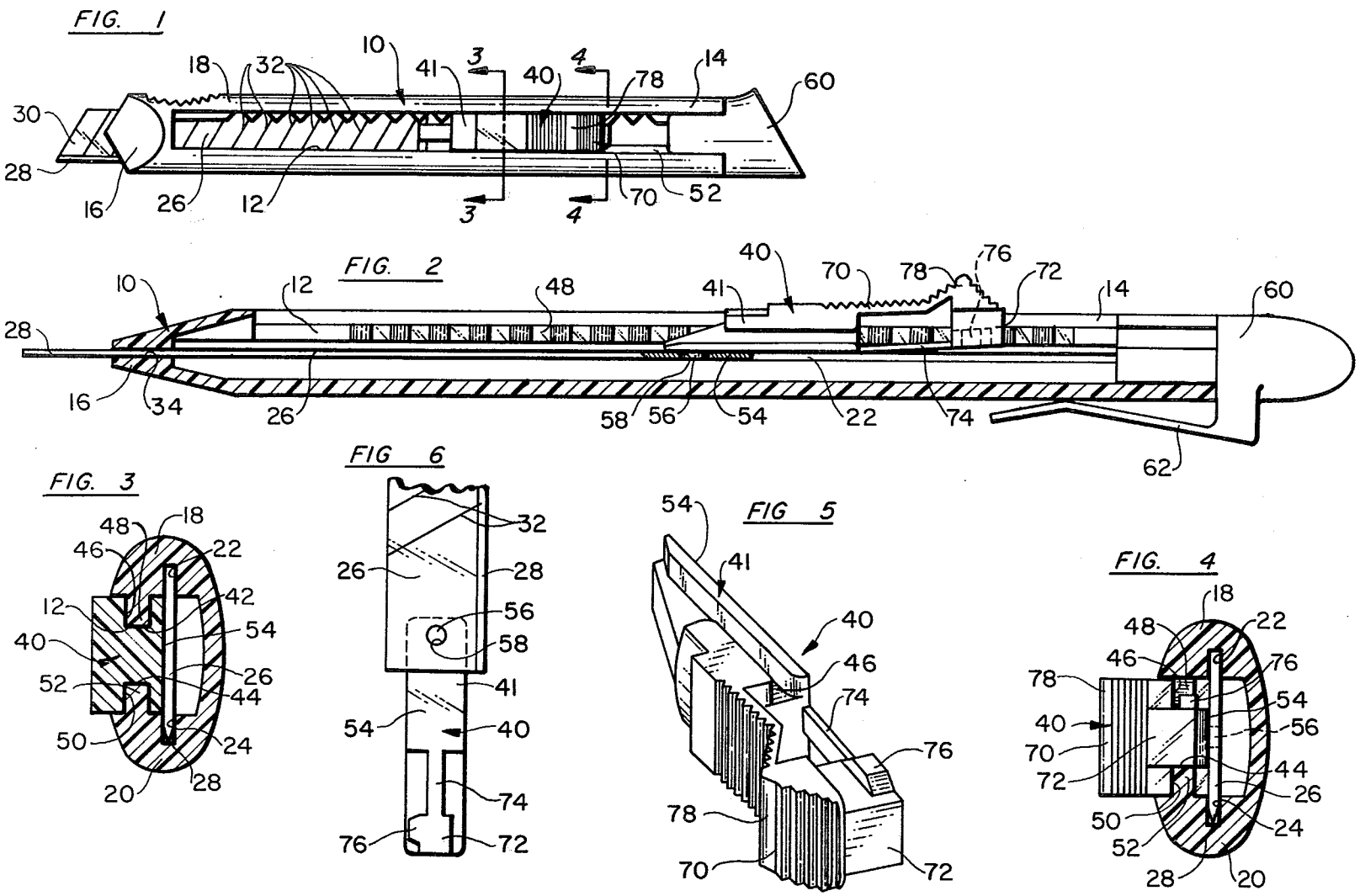
FIG. 1 is a side elevational view of a retractable blade knife embodying the invention.
FIG. 2 is an enlarged plan view thereof, partially in section.
FIG. 3 is a cross-sectional view taken along the line 3—3 of FIG. 1.
FIG. 4 is a cross-sectional view taken along the line 4—4 of FIG. 1.
FIG. 5 is an enlarged perspective view of the blade positioning slide and latching member.
FIG. 6 is a fragmentary bottom view of the slide, and latching member with a segment of the blade attached thereto.

Referring to the exemplary knife embodying the invention shown in the drawing, it will be seen that the handle of the knife is in the form of an elongate tubular casing 10 preferably molded as a unitary structure using a suitable plastics material such as mineral filled nylon. One side of the casing has an elongated slot 12 extending from the right hand end 14 as viewed in FIGS. 1 and 2 adjacent the tapered front end 16 with the result that for most of its length, the casing 10 is generally C-shaped in cross-section as best seen in FIGS. 3 and 4.

Inside the casing 10 centrally of the top and bottom walls 18, 20 are a pair of opposed grooves 22, 24 extending longitudinally of the casing 10 forming a guideway for a metal blade 26. The blade 26 is the form of an elongated flat, thin steel strip which is sharpened along the lower edge 28 with the point of the blade being formed by an inclined front edge 30. The blade 26 is preferably formed with a series of score lines 32 parallel to the front edge 30 so that when a sharp new point is required this can be obtained by snapping off a section of the blade at the leading score line. The tapered front end 16 of the casing has a slot 34 in alinement with the grooves 22, 24 so that the front end 30 of the blade 26 may protrude therethrough when it is extended into cutting position as shown in FIGS. 1 and 2.

In accordance with the invention, the blade 26 is positioned, and also extended and retracted, by means of a combination slide and latching member 40 best shown viewed in perspective in FIG. 5. The member 40 is preferably a unitary structure of molded plastics material having resilience and low friction properties. The slide portion 41 which is at the forward end when the member 40 is inserted into the handle, is dimensioned to fit between the side edges 42, 44 of the casing 10 which define the slot 12. The upper edge of the slide 41 as viewed in FIGS. 3–6 has a longitudinal groove 46 into which extends a row of teeth 48 integrally formed along the edge 42 of the slot 12. The opposite side of the slide 41 has a similar groove 50 in which is received the rib 52 integrally formed on the side edge 44 of slot 12. When the member 40 is inserted into the casing as shown, the slide 41 in effect rides on the side edges 42, 44 of the slot 12 and is able to be moved longitudinally along the slot 12 while being guided by the row of teeth 48 positioned in groove 46 and the engagement of rib 52 in the groove 50. When mounted in the slot 12, the bottom surface 54 of the slide 41 rests against the blade 26 and is releasably connected thereto by means of an integrally formed projection or pin 56 which is received in a hole 58 in the blade 26. An end piece or cap 60 having an integrally formed clip 62 is provided for closing the open end of the handle 10 which is the right-hand end as viewed in FIGS. 1 and 2. The cap 60 is removed when it is desired to withdraw the member 40 from the handle to detach it from the blade 26 and to replace the blade.

Turning now to the latching portion of the member 40, this comprises a rearwardly extending integrally formed serrated cantilevered thumbpiece 70 having a downwardly depending abutment 72 at its outer end which in turn is connected to the base of the slide 41 by an integrally formed strap 74. In the normal unstressed position of the latching portion, the strap 74 is slightly angled upwardly from the base of the slide 41 as best shown in FIG. 2. A tooth 76 is integrally formed on the abutment 72 for engagement with the row of teeth 48.

The thumbpiece 70 preferably has a portion 78 which is in the shape of an inverted V which makes it easy for the user to apply pressure to the thumbpiece simultaneously inwardly and longitudinally in either direction when it is desired to unlatch and move the blade 26.

The thumbpiece 70 and depending abutment 72 in normal unstressed condition assume the position shown in FIG. 2 in which position the tooth 76 lies in the plane of teeth 48 and is meshed with the teeth 48, thus latching the member 40 against movement along the slot 12. Since the width of the abutment 72 is only slightly less than the width of the slot 12, the abutment cannot be moved sideways to disengage the tooth 76 manually or wedged sideways by a tooth due to pressure on the end of the blade, and the only way the member 40 can be unlatched is by pressure on the thumbpiece 70 bending or depressing it inwardly causing the tooth 76 to move laterally out of engagement with the row of teeth 48.

In combination, the thumbpiece 70 and connecting strap 74 are designed to be sufficiently stiff so as to resist inward flexing of the thumbpiece which minimizes inadvertent unlatching of the member 40 but, at the same time, not excessively stiff so that unlatching is made difficult. As previously mentioned, the portion 78 of the thumbpiece 70 is designed so that the operator can simultaneously press in on the thumbpiece 70 and move the member 40 longitudinally in a one-handed operation. When released, the thumbpiece 70 and strap 74 being resilient immediately return the abutment 72 and tooth 76 to latching position.

It thus will be seen that a simplified positioning and latching means for the blade of a retractable blade knife has been provided which, at the same time, is secure against unlatching when the knife is in use. Also, as will be apparent to persons skilled in the art, various modifications, adaptations and variations of the foregoing specific disclosure can be made without departing from the teachings of the present invention.

I claim:

1. A retractable blade knife comprising an elongated tubular handle of generally C-shaped cross-section having a longitudinally extending slot in one wall thereof formed with opposed parallel side edges, a flat thin elongate steel blade, a pair of opposed inwardly facing grooves inside the handle mounting the blade for sliding movement parallel to the slot, a longitudinally extending rib formed on one of said side edges and a row of contiguous teeth formed on the other of said side edges facing and in opposed relationship to the rib, a combined slide and latching member for positioning the blade relative to the housing comprising a slide dimensioned to fit between the side edges of the slot and having outwardly facing side grooves receiving the longitudinally extending rib and the row of teeth on the side edges of the slot whereby the slide is supported for sliding movement longitudinally of the handle, means releasably interconnecting the slide and the blade, a flexible thumbpiece extending upwardly and rearwardly from the slide and having a depending abutment at its free end extending inwardly between the longitudinally extending rib and the row of contiguous teeth, and a tooth carried by and extending outwardly from the side of the depending abutment of the thumbpiece facing and normally meshing with said row of teeth and being disengaged therefrom when the thumbpiece is flexed inwardly toward the handle thereby moving the thumbpiece laterally of the row of teeth.

2. A retractable blade knife as defined in claim 1 wherein the thumbpiece is reinforced by an integrally formed strap extending underneath and spaced from the thumbpiece between the inner end of the abutment and the slide.

3. A retractable blade knife as defined in claim 1 or 2 wherein the thumbpiece has a portion which is in the shape of an inverted V in cross-section for facilitating the application of pressure thereto by the user which is directed both inwardly and longitudinally of the handle.

* * * * *